US006841019B2

(12) United States Patent
Scaife

(10) Patent No.: US 6,841,019 B2
(45) Date of Patent: Jan. 11, 2005

(54) PROCESS FOR SPLICING THE BOTTOM END PORTION OF THE FIRST STACK OF WEB MATERIAL AND THE TOP END PORTION OF THE SECOND STACK OF THE MATERIAL

(75) Inventor: Martin Scaife, Ashford (GB)

(73) Assignee: The Procter + Gamble Company, Cincinnati, OH (US)

( * ) Notice: Subject to any disclaimer, the term of this patent is extended or adjusted under 35 U.S.C. 154(b) by 0 days.

(21) Appl. No.: 10/149,214

(22) PCT Filed: Dec. 8, 2000

(86) PCT No.: PCT/US00/33251

§ 371 (c)(1),
(2), (4) Date: Oct. 1, 2003

(87) PCT Pub. No.: WO01/42119

PCT Pub. Date: Jun. 14, 2001

(65) Prior Publication Data

US 2004/0182496 A1 Sep. 23, 2004

(30) Foreign Application Priority Data

Dec. 10, 1999 (EP) ..... 99124638

(51) Int. Cl.[7] ..... B32B 31/16

(52) U.S. Cl. ..... 156/73.4; 156/73.1; 156/157

(58) Field of Search ..... 156/73.1, 73.4, 156/157, 304.1, 308.2, 502, 580.1, 580.2

(56) References Cited

U.S. PATENT DOCUMENTS

| | | | | |
|---|---|---|---|---|
| 3,729,367 A | | 4/1973 | Shore et al. | |
| 4,838,964 A | * | 6/1989 | Thomsen et al. | 156/73.1 |
| 4,878,985 A | * | 11/1989 | Thomsen et al. | 156/459 |
| 5,085,624 A | | 2/1992 | Felix | |
| 5,207,854 A | * | 5/1993 | Becking | 156/350 |
| 5,223,070 A | * | 6/1993 | Tsubone | 156/353 |
| 5,232,529 A | * | 8/1993 | Miyake | 156/73.4 |

FOREIGN PATENT DOCUMENTS

| | | |
|---|---|---|
| EP | 0 383 501 A2 | 8/1990 |
| EP | 0 763 491 A2 | 3/1997 |
| WO | WO 98/58864 A1 | 12/1998 |

* cited by examiner

*Primary Examiner*—James Sells
(74) *Attorney, Agent, or Firm*—Jack L. Oney, Jr.; Jay A. Krebs; Ken K. Patel

(57) ABSTRACT

The present invention provides a method for splicing a strip of material packaged in stacks arranged parallel to each other. The method comprises a step of reversely rotating the bottom end portion around the transverse edge of the bottom end portion and/or reversely rotating the top end portion around the transverse edge of the bottom end portion until the longitudinal tangential vector of the bottom end portion forms an angle of 90 and 270 degrees with the longitudinal tangential vector of the top end portion.

10 Claims, No Drawings

PROCESS FOR SPLICING THE BOTTOM END PORTION OF THE FIRST STACK OF WEB MATERIAL AND THE TOP END PORTION OF THE SECOND STACK OF THE MATERIAL

FIELD OF THE INVENTION

The present invention provides an apparatus for splicing a strip of material packaged in stacks arranged parallel to each other.

BACKGROUND

In online manufacturing of articles, materials are often supplied as web materials and subsequently cut into pieces during the manufacturing process. The supply of web materials has the advantage that large quantities of the material can be supplied to the manufacturing process as a single piece of web material. The web material may be supplied as roll stock or in festooned form. The latter form is preferred when the web material has a relatively large thickness dimension such that the lifetime of a roll of this material would be relatively short.

Packages of festooned web material are well known in the art and are described for example in documents U.S. Pat. No. 3,729,367 (Shore), EP-A-0 366 038 (Felix), EP-A-0 383 501 (Foster).

There have also been described, see for example WO-A-98/58864 (O'Connor et al.), packages of festooned web material in which a plurality of stacks of the material has been arranged in side-by-side fashion such that by splicing the end of one that to the beginning of the neighboring stack one continuous strip of web material can be obtained. The slices, however, had to be carried out by hand in particular because the arrangement of the stacks requires that one of the into pieces is twisted by an annual 360 degrees around the longitudinal dimension of the web material.

Therefore, it has been an object of the present invention to provide an apparatus and a process for automatic splicing of neighboring stacks of festooned web material.

SUMMARY OF THE INVENTION

The process of the present invention allows splicing of parallel stacks of web material with increased speed and increased accuracy compared to splicing by hand.

DETAILED DESCRIPTION OF THE INVENTION

The present invention provides a method for splicing the end connecting portion of a first stack in a multi-lane festooned package of web material to the beginning portion of the second stack of web material within the same package.

The term "web material" as used herein refers to a sheet-like material, or to a composite or laminate comprising two or more sheet-like materials. For example, a web material can be a fibrous web, a non-fibrous web, a woven web, a nonwoven web, a foam, a film, or the like. The web material has a longitudinal dimension, a transverse dimension, and a thickness dimension. The longitudinal dimension of the material is substantially larger than the transverse dimension and than the thickness dimension. Typically, the material is supplied to the manufacturing process along the longitudinal dimension. Accordingly, the material is ideally rendered virtually infinite in the longitudinal dimension by splicing together a plurality of stretches of web material. By cutting the web material perpendicular to the longitudinal dimension, pieces of the material suitable for incorporation into the article manufacture are obtained. Typically, the pieces of material which are incorporated into the article manufacture have the same transverse dimension and thickness dimension as the web material. Due to the sheet like nature of the web material, the thickness dimension is typically smaller than the thickness dimension.

The term "multi-lane festooned package of web material" as used herein refers to a plurality of stacks of web material which are arranged in parallel. Within the individual stacks, the material is folded in a zigzag fashion and extends continuously from a bottom end portion to a top end portion where the material is folded at lines substantially perpendicular to the longitudinal dimension of the web material. The individual stacks of the multilane festooned package may be completely independent of each other or the individual stacks may be separated from each other by a perforation line. If the individual stacks are only separated by a perforation line, the overall stability of the package is increased. Examples for multi-lane festooned packages of web material can be found in documents U.S. Pat. No. 3,729,367 (stacks separated by perforation) and WO-A-98/58864 (individual stacks), both documents being incorporated herein by reference. For the purpose of the present invention, a Cartesian coordinate system is defined relative to the multilane festooned package of web material which is to be spliced by the process of the present invention. The x--dimension of this coordinate system is defined to be substantially parallel to the fold lines of the material within the individual stacks, i.e. the side surfaces of the individual stacks are perpendicular to the x--direction. The y--dimension is defined to be substantially parallel to the longitudinal dimension of the web material in between the folds. Accordingly, the z--dimension is defined to be height dimension of the individual stacks, i.e. the z--dimension is perpendicular to the major surface is of the web material in between the folds.

For example, multi-lane festooned packages of material are particularly useful in the manufacture of disposable articles, in particular disposable absorbent articles such as diapers, sanitary napkins, adult incontinence products, bed mats, bibs, and the like.

To be able to provide a long-lasting supply of web material to the process of manufacture, it is desirable to connect the different stacks of the material by splicing the bottom and portion of one stack to the top end portion of the neighboring stack or any other stack. As is readily apparent to the skilled person, such a splice requires a 360° twist around the longitudinal dimension of one of the end portions to be connected. This is particularly true for two sided web materials, i.e. for those materials which have a first major surface which is different from the second major surface.

The process of the present invention comprises a step of holding the bottom end portion of the first stack of web material. The process further comprises a step of holding the top end portion of the second stack of web material. Optionally, the process of the present invention may comprise stacks of automatically locating and grabbing the bottom end portion and/or the top end portion from the multilane festooned package of web material. In case the individual stacks of the package are separated by lines of perforation, the process of the present invention may further comprise steps of separating the bottom end portion and/or top end portion from a neighboring bottom end portion or top end portion respectively. In case material has to be separated by tearing open a perforation, the quality of the perforation may checked automatically while performing the splice.

After holding the bottom end portion of the first stack of web material and after holding the top end portion of the second stack of web material, the process of the present invention comprises a further step of reversely rotating the bottom end portion around its transverse edge and/or reversely rotating the top end portion around its transverse edge until the longitudinal tangential vector of the bottom end portion forms an angle of between 90° and 270°, preferably between 120° and 240°, more preferably between 150° and 210°, most preferably about 180° with the longitudinal tangential vector of the top end portion. The longitudinal tangential vector of the end portions are considered to be tangential to the major surface of the web material in a longitudinal direction pointing away from the respective end portion. The term "reverse rotation" as used herein refers to that rotation which turns the inner major surface of the respective end portion to the outside. In this context, the inner major surface of the respective and portion is defined to be that major surface which faces the remainder of the stack of web material to which the end portion belongs. As have surprisingly be found, the step of reversely rotating in the bottom end portion and/or the top end portion and the subsequent joining of the two end portions yields the 360° twist around the longitudinal dimension of the web material required for continuous de-festooning.

Subsequent to the reverse rotation of the bottom end portion and/or the top end portion, the process of the present invention comprises a step of joining the bottom end portion to the top end portion. A wide variety of suitable joining processes are known in the art including but not limited to ultrasonic bonding, adhesive bonding, thermobonding, pressure bonding, sewing, and the like. The process of ultrasonic bonding is particularly preferred for its low impact on to the web material. Depending on the specific material properties of the web material, however, the most suitable joining process will be readily apparent to the skilled person. The step of joining also comprises the relative positioning of the bottom end portion and the top end portion to be accessible for splicing. During such positioning care has to be taken to not entangle the bottom end portion with the top end portion. Movements of at least one of the end portions in the respective transverse direction may assist in resolving potential entanglement problems. For the joining of the bottom end portion to the top end portion, the bottom end portion and the top end portion may be positioned relative to each other such that the bottom end portion is on top of and overlapping the top end portion. Alternatively, the bottom end portion of the top end portion may be arranged prior to joining such that to transverse edges contact each other so that the two end portions are joined in non-overlapping fashion. Optionally, an additional piece of material may be joined to the two end portions of support such a non-overlapping splice.

The process of the present invention optionally comprises a step of positioning the transverse edge of the bottom end portion and the transverse edge of the top end portion such that both edges are substantially parallel to each other prior to joining the bottom end portion to the top end portion. Such arrangement of the end portions will contribute to the quality of the splices.

Whist in the present description, only the consecutive splicing of a plurality of neighboring has been described, the concept of the process of the present invention may also be applied to simultaneous splicing of a plurality of bottom end portion to the respective top end portion or vice versa. Such a simultaneous process is also considered to form part of the present invention.

It is considered that the construction of an apparatus to carry out the process of the present invention lies within the customary practice of the person skilled in the art. It is further considered that the deployment of servo motors which may be controlled by a computer program in combination with sensors, in particular optical sensors, is beneficial for the construction of such an apparatus.

What is claimed is:

1. A process for splicing the bottom end portion of a web material in a first stack to a top end portion of a web material in a second stack, said process comprising the following steps
- providing a first stack of web material
- providing a second stack of web material
- arranging said second stack parallel to said first stack
- holding said bottom end portion of said first stack of web material
- holding said top end portion of said second stack of web material
- reversely rotating said bottom end portion around the transverse edge of said bottom end portion and/or reversely rotating said top end portion around the transverse edge of said bottom end portion until the longitudinal tangential vector of the bottom end portion forms and angle of 90 and 270 degrees with the longitudinal tangential vector of the top end portion
- joining said bottom end portion to said top end portion.

2. A process according to claim 1 wherein said process further comprises the step of automatically locating and grabbing said bottom end portion.

3. A process according to claim 2 wherein said process further comprises a step of separating said bottom end portion from a second bottom end portion by tearing a perforation line.

4. A process according to claim 1 wherein said process further comprises the step of automatically locating and grabbing said top end portion.

5. A process according to claim 4
wherein said process further comprises a step of separating said top end portion from a second top end portion by tearing a perforation line.

6. A process according to claim 1
wherein said process further comprises a step of positioning the transverse edge of said bottom end portion and the transverse edge of the top end portion such that both edges are substantially parallel prior to joining said bottom end portion to said top end portion.

7. A process according to claim 1
wherein said bottom end portion and said top end portion are positioned relative to each other such that said bottom end portion is on top of and overlapping said top end portion prior to joining said bottom end portion to said top end portion.

8. A process according to claim 1
wherein said bottom end portion is joined to said top end portion by means of ultrasonic bonding.

9. A process according to claim 1
wherein said first stack of web material and said second stack of web material are comprised in the same multilane festooned package of web material.

10. A process according to claim 1
wherein said web material is a nonwoven material, preferably a highloft nonwoven material.

* * * * *

UNITED STATES PATENT AND TRADEMARK OFFICE

CERTIFICATE OF CORRECTION

PATENT NO. : 6,841,019 B2
DATED : January 11, 2005
INVENTOR(S) : Scaife

It is certified that error appears in the above-identified patent and that said Letters Patent is hereby corrected as shown below:

Column 4,
Line 50, delete "and angle of 90" and insert therefor -- an angle of between 90 --.

Signed and Sealed this

Tenth Day of May, 2005

JON W. DUDAS
*Director of the United States Patent and Trademark Office*